United States Patent [19]

Howard, Sr.

[11] Patent Number: 4,747,453

[45] Date of Patent: May 31, 1988

[54] SECURITY COVER AND HOUSING FOR A WELL

[76] Inventor: Oscar Howard, Sr., Rte. 9, Box 247, Kinston, N.C. 28501

[21] Appl. No.: 22,770

[22] Filed: Mar. 6, 1987

[51] Int. Cl.[4] ..... B65D 55/14; E02D 29/10; D21B 33/037

[52] U.S. Cl. ..... 166/379; 52/20; 70/161; 166/96; 220/18

[58] Field of Search ..... 166/75.1, 81, 85, 91–94, 166/96, 97, 278, 286, 379; 70/158, 159, 161, 163, 164; 52/20; 220/18; 405/25

[56] References Cited

U.S. PATENT DOCUMENTS

| | | | |
|---|---|---|---|
| 2,179,191 | 11/1939 | McWilliams | 166/92 |
| 2,532,341 | 12/1950 | Shannon | 166/96 |
| 2,988,144 | 6/1961 | Conrad | 166/96 X |
| 3,239,004 | 3/1966 | Coberly | 166/75.1 |
| 3,972,440 | 8/1976 | Warren | 220/18 |
| 4,334,578 | 6/1982 | Labrum | 166/75.1 |
| 4,461,597 | 7/1984 | Laurin | 404/25 |
| 4,615,362 | 10/1986 | Hartman et al. | 52/20 |
| 4,666,333 | 5/1987 | Armstrong | 404/25 |

*Primary Examiner*—George A. Suchfield
*Attorney, Agent, or Firm*—Rhodes, Coats & Bennett

[57] ABSTRACT

A security cover and housing for closing, securing and protecting a well and more particularly a well pipe. The well cover and housing comprises an open cylindrical main housing with an outwardly projecting flange that is designed to support the cylindrical housing within the well opening. A well pipe retainer insert fits within the cylindrical housing and generally surrounds and supports an upwardly projecting well pipe. A locking plate is adapted to be secured over the well pipe retainer and the well pipe. A top plate is adapted to fit onto the cylindrical opening of the main housing structure about the top portion thereof to form a closed flat upper surface.

15 Claims, 5 Drawing Sheets

SECURITY COVER AND HOUSING FOR A WELL

FIELD OF THE INVENTION

The present invention relates to well covers and housing structures for covering wells, and more particularly to a flush surface supported security well cover of the type that is designed to engage and support a well pipe.

BACKGROUND OF THE INVENTION

A well structure includes a bored opening within the ground and has a well pipe extending upwardly through the ground opening. Generally the well pipe includes a top that terminates just below the surface area of the earth.

To protect and secure a well of this type it is common practice to provide a well cover or housing that extends over the well structure. Such security type well covers or housings are particularly important for example, in the case of wells provided by state and federal agencies to test ground water. Obviously in these cases, it is important that the well not be tampered with between tests.

Security type well covers and housings are known and are commercially available. For a general appreciation of the state of the art in the area of security well covers one is referred to the disclosures found in the following U.S. Pat. Nos. : 4,461,597; 4,337,005; 3,561,470; 1,459,462; and 1,384,712.

But security type well covers and housings that are known today and those which are commercially available do have short comings and drawbacks. Most importantly, many such security type well covers are not really tamper proof. That is they are relatively easy to open and upon opening one can gain access to the underlying well pipe. Beyond that, many such security well covers are not strong, sturdy and durable. In this case, even those that might mount flush or level with the ground are subject to damage in the event that they are engaged by a passing vehicle.

SUMMARY AND OBJECTS OF THE INVENTION

The present invention presents a security well cover or housing that is designed to overcome the drawbacks and shortcoming of security covers presently known.

In the case of the present invention, the security well cover is self-supporting inasmuch as the structure thereof is such that a main outer housing structure is designed to be inserted into the ground opening and outwardly projecting flanges project over the surrounding surface of the opening in the ground and provides support for the entire outer housing. In addition, the security well cover and housing of the present invention is provided with a well pipe retainer that is designed to fit within the main outer housing structure and which automatically aligns and centers the well pipe therein. In fact, the well pipe retainer actually supports the well pipe and also is designed such that filler material such as sand and gravel can be poured downwardly between the side walls of the outer main housing structure and the well pipe retainer.

A locking plate device is provided and adapted to be secured to the well pipe retainer or insert and when disposed in a locked mode prevents access to area there-below and to the area surrounding the top portions of the well pipe.

Moreover, there is provided a top plate that fits within the main outer housing so as to close the top of the security cover or housing such that vehicles can conveniently pass thereover.

It is therefore an object of the present invention to provide a security well cover or housing that is effectively tamperproof and which will secure and protect a well.

Still another object of the present invention resides in the provision of a security well cover that is strong, durable and which will support vehicles passing thereover.

Another object of the present invention resides in the provision of a security well cover or housing design of the character referred to above that is self-supporting and which is designed to be mounted about the top area of a well such that the top of the security cover or housing lies approximately at surface level.

Another object of the present invention resides in the provision of a security well cover or housing that can be easily and conveniently moved from one location to another thereby enabling the same security cover or housing to be used in conjunction with a number of wells.

Still a further object of the present invention resides in the provision of a security well cover that is designed to be mounted in concrete or designed to be simply self-supporting about the upper area of a well.

Still a further object of the present invention resides in the provision of a security well cover that is useful in securing wells and is also beneficial in the actual construction of the well.

Other objects and advantages of the present invention will become apparent and obvious frm a study of the following description and the accompanying drawings which are merely illustrative of such invention.

DETAILED DESCRIPTION OF INVENTION

Figure 1:
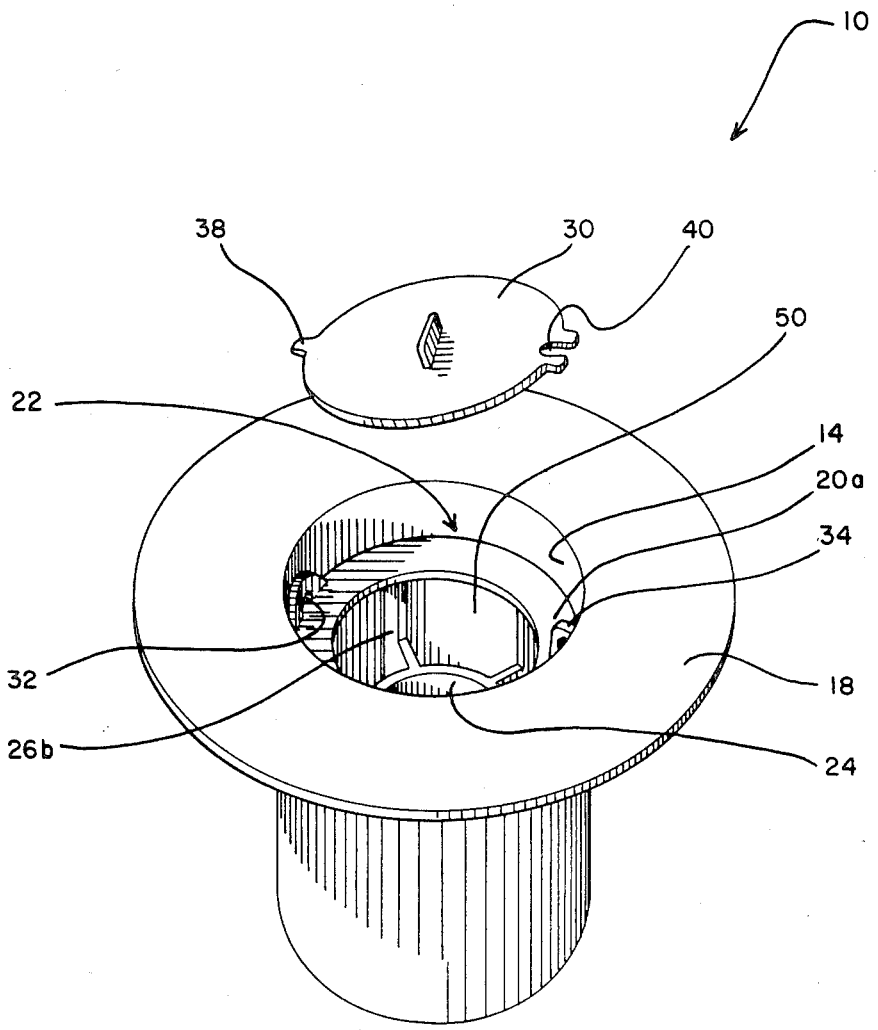
FIG. 1 is a perspective view of the security well cover of the present invention with the locking plate thereof being removed to better illustrate the internal structure of the security well cover.
Figure 2:
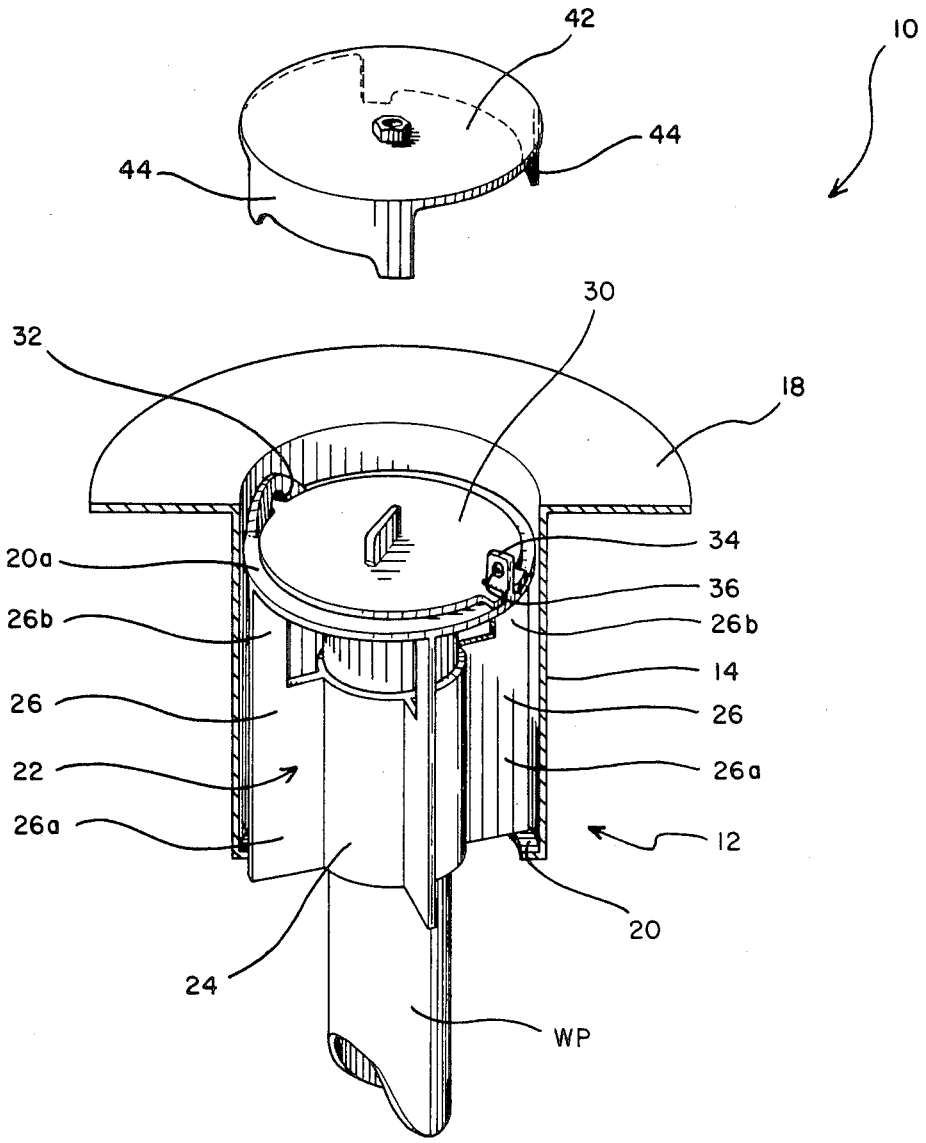
FIG. 2 is a perspective longitudinal sectional view of the security well cover of the present invention showing and illustrating the same securing a well pipe.

With further reference to the drawings, there is shown therein a security well cover or housing structure that is indicated generally by the numeral 10.

Viewing security well housing 10 in more detail the same comprises an outer main housing structure indicated generally by the numeral 12. (FIG. 3) Main housing structure 12 comprises a cylindrical wall 14 that includes a central opening 16 extending therethrough. Secured to the upper end of the cylindrical wall 14 is an upper surface support flange 18 that extends around the circumference of the upper end of the cylindrical wall. Formed about the lower end of the main housing 12 is a lower innerprojecting flange 20 that, as will be understood from subsequent portions of this disclosure, form a seat.

In addition, the well security housing 10 comprises a well pipe retainer insert that is indicated generally by numeral 22. Well pipe retainer insert 22 is designed to be received within the central opening 16 of the main outer housing structure and is adapted to seat or rest on lower flange 20.

Viewing well pipe retainer 22 it is seen the same comprises a well pipe holder 24 in the form of an open cylindrical collar. The cylindrical collar 24 is of a diameter large enough to accommodate a selected well pipe WP which will be discussed in subsequent portions of this disclosure.

Secured to the well pipe holder 24 and projecting radially therefrom are a plurality of equally spaced support ribs 26. Each rib 26 include a lower rib section **26*a* that extends the height of the well pipe holder 24. Spaced outwardly from the well pipe holder and extending upwardly is an upper rib portion 26*b*. The upper terminal end of the ribs 26 are secured to annular seat 20*a***.

A locking plate assembly is provided for the security well housing 10 and is designed to extend over the well pipe holder or insert 22 and to close the area occupied by the well pipe and well pipe holder 24. Viewing this locking plate assembly it is seen that the same includes a locking plate 30 that is adapted to be connected and secured onto the annular seat **20*a* of the well pipe insert 22**.

To provide the locking structure mechanism to secure locking plate 30 onto annular seat **20*a* there is provided an insert opening 32 formed on the top surface of annular seat 20*a*. Opposite insert opening 32 is an upstanding locking tab 34 that extends upwardly from annular seat 28 also. An opening 36 is formed in the locking tab 34** so as to receive a padlock.

Referring back to locking plate 30, the same is provided with a projecting outer tab 38 that is designed to be received within insert opening 32. Opposite projecting tab 38 there is provided in locking plate 30 a slitted opening 40 that is designed to sandwich locking tab 34.

Therefore, it is appreciated that by inserting projecting tab 38 within insert opening 32 and by appropriately sandwiching locking tab 34 with the slitted opening 40 and by placing a padlock within opening 36, that such will securely lock the locking plate 30 to the well pipe retainer or insert 22.

It is appreciated that in the normal operative mode or position, that the well pipe insert 22 and the locking plate 30 assume a position in the lower portion of the main housing 12.

To close the top portion of main housing 12 there is provided a top 42 that is adapted to be inserted within the central opening 16. Top 42 includes a spacer 44 that projects downwardly from the top and which engages the annular seat **20*a*. Spacer 44 is of a selected height so as to assure that top 42 and the upper flanges 18 lie in the same plane. This, as seen in the drawings, flange 18 and top 42 form a level closed surface about the well housing 10** when the same is in an inserted operative mode.

Figure 3:
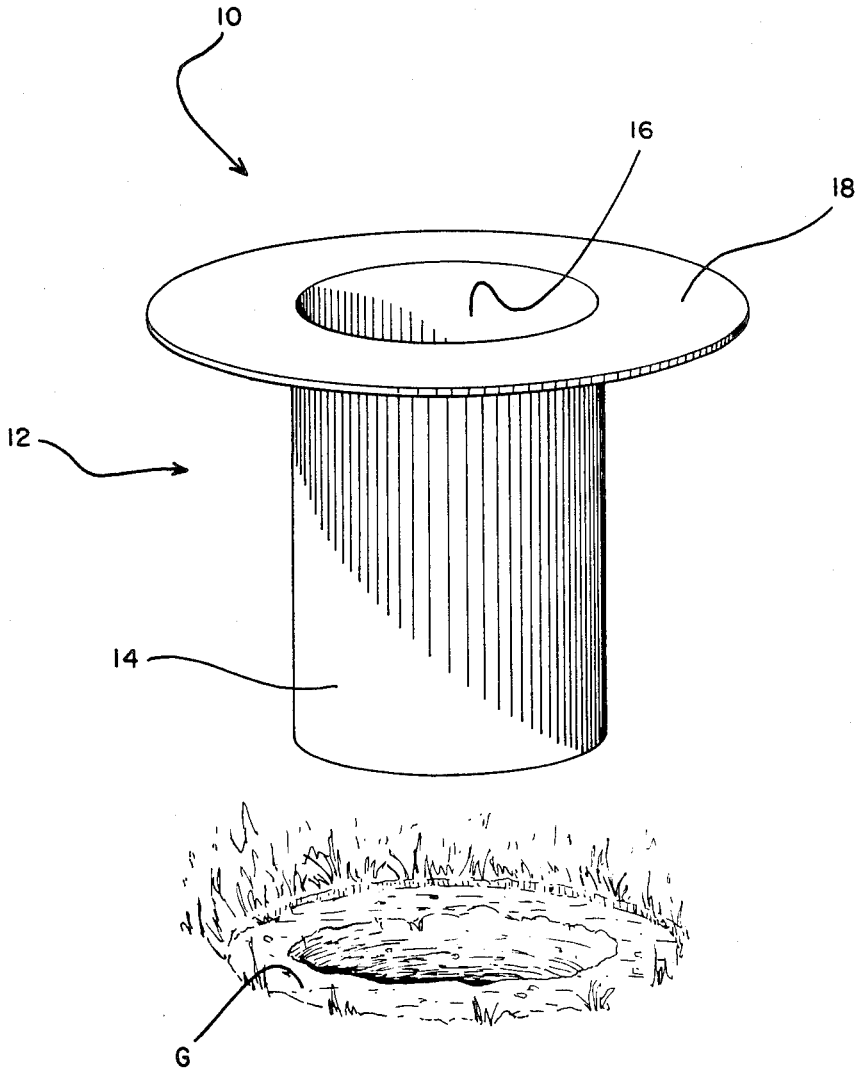
FIG. 3 is a perspective view of a main outer housing structure of the security well cover of the present invention being disposed over an opening formed in a ground area.
Figure 4:
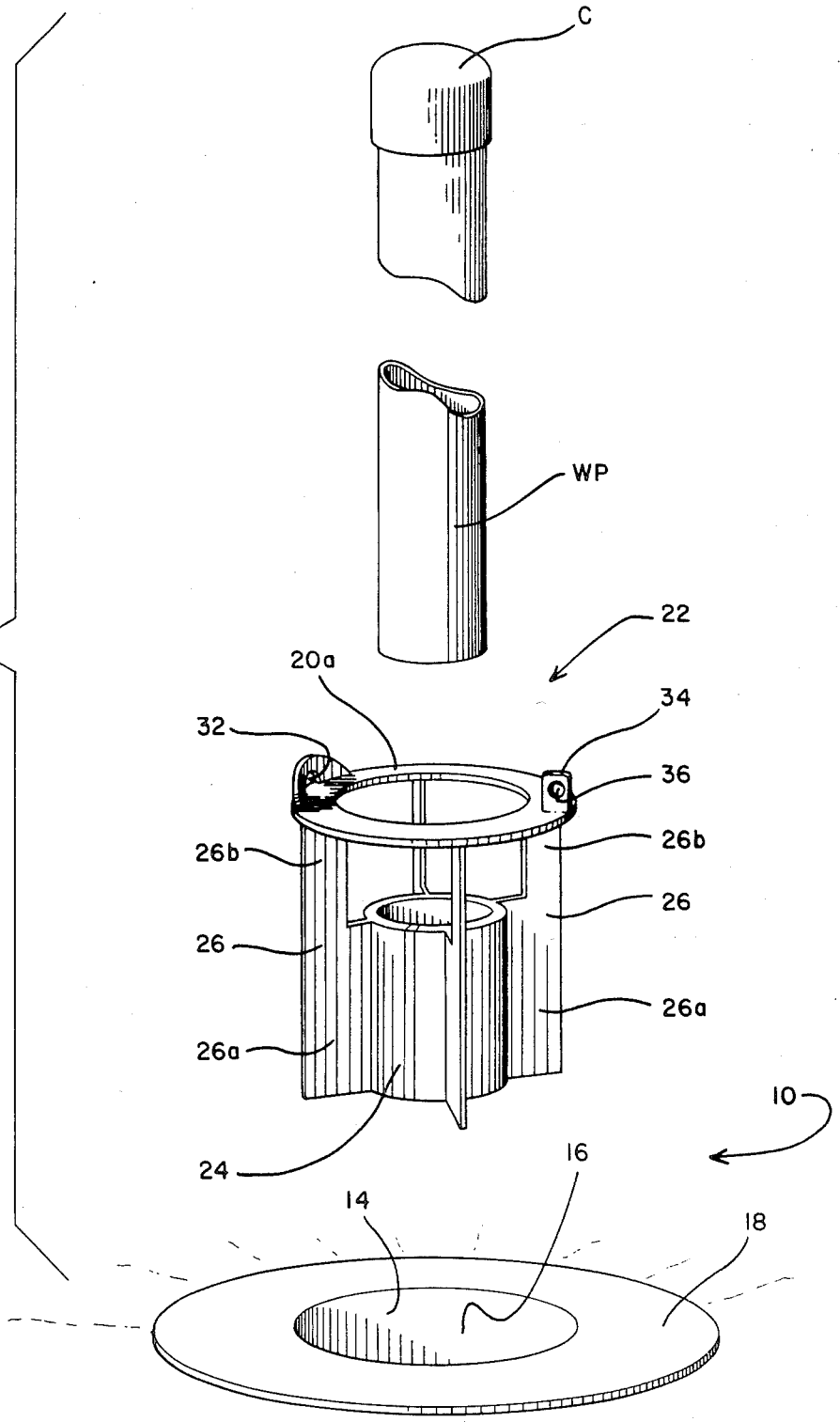
FIG. 4 is a sectional view showing various components of the security well cover of the present invention along with a well pipe in an exploded arrangement.
Figure 5:
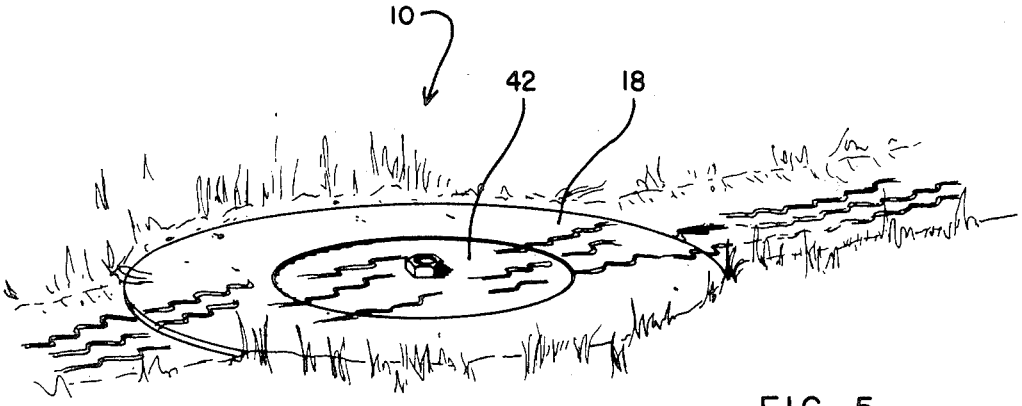
FIG. 5 is a perspective view of the security well cover of the present invention shown installed in the ground with the top portion thereof being flush with the ground.
Figure 6:
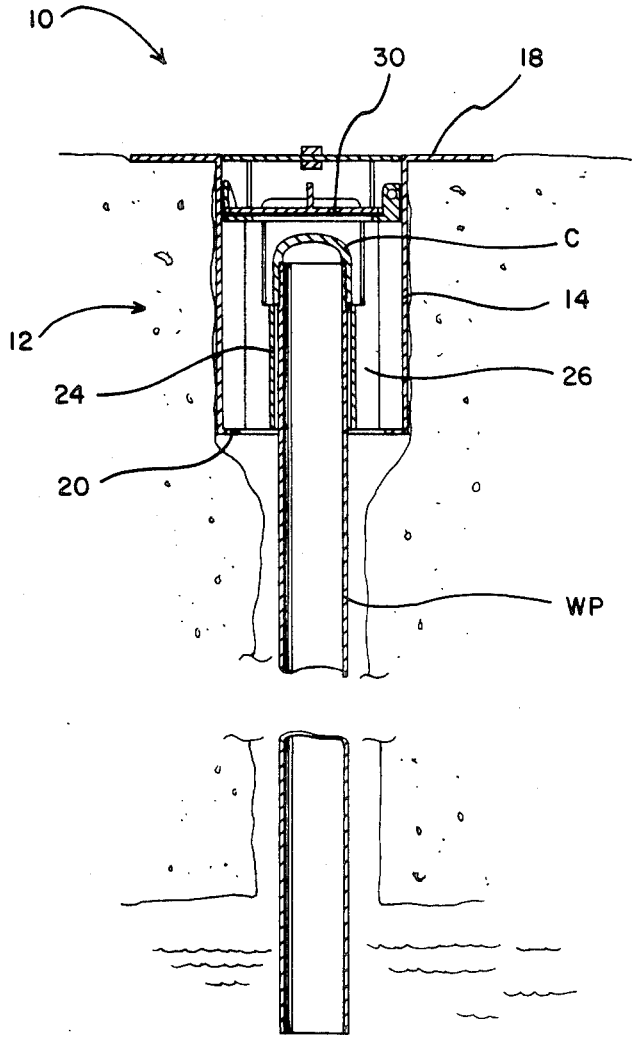
FIG. 6 is a longitudinal sectional view of the security well cover of the present invention inserted within the ground and housing and supporting a well pipe extending downwardly down through the ground.

The security well housing 10 just described is designed to be used in conjunction with a well structure such as that illustrated in FIGS. 3 and 6. Reviewing this well structure it is seen that the same includes a bored vertical ground opening G. Extending vertically through the ground opening G is a conventional well pipe WP that includes a top cap C.

In an operative installed position or mode, note that the main housing structure 12 is inserted within the ground opening G such that the upper support flange 18 thereof rests adjacent the surrounding surface of the ground opening G. This effectively supports the entire well housing structure 10 within the ground opening G.

Also, as viewed in FIG. 6, note that the well pipe WP extends upwardly through the cylindrical collar 24 of the well pipe insert. Note that the cap C is of a greater diameter than the inside diameter of the cylindrical collar 24. This enables the well pipe insert or well pipe cylindrical collar 24 to actually support the well pipe WP within the security well housing 10. It is also appreciated that the well pipe insert or retainer 22 effectively aligns the well pipe WP within the security well housing 10.

In addition, as seen in FIG. 1, there is a series of openings 50 defined between the respective ribs 26. These openings enable filler materials such as sand or gravel to be poured therethrough and directed into the well opening G so as to fill the areas in and around the well pipe WP.

In fact, in constructing a well and installing the well pipe WP, the security well cover or housing structure 10 of the present invention can be used. In this regard, the main housing 12 can be inserted in the ground opening G. Next the well pipe retainer insert 22 can be placed within the central opening 16. Thereafter the well pipe WP can be inserted downwardly into the opening through the well pipe cylindrical collar 24. Thereafter material can be poured through the openings between the ribs 26 to fill the areas of the ground opening G that lie in and around the well pipe WP.

From the foregoing specifications and discussion, it is appreciated that the present invention presents a relatively strong, sturdy and tamperproof security well cover or housing. Of particular importance is the relatively simple design that make the multipiece apparatus easy to construct and manufacture. In addition, the well cover and security housing of the present invention can be removed from one well and placed at the site of another well.

The present invention, may of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A surface security housing for securing a well of the type having an elongated vertical ground opening and a well pipe extending vertically therethrough, said well security housing comprising:

(a) a main outer structure having a surrounding wall and an opening extending completely therethrough and an outwardly projecting flange extending from the top of the main outer structure for engaging the surface of the surrounding ground opening so as to support the entire main outer structure in an inserted position within that ground opening;

(b) the well pipe aligning insert, separate and independent of the main outer structure, and adapted to be held and supported within the opening of said main outer structure, said insert including an opening for receiving the well pipe and for maintaining the well pipe in a generally centrally disposed position within the main outer structure;

(c) means for supporting said pipe aligning insert within the opening of said outer structure;

(d) detachable locking plate means for extending horizontally across the opening of said outer structure at an intermediate height level therein but at a height at least above the position normally occupied by the pipe aligning insert for securing and preventing access to the well pipe and the open ground area surrounding the same; and (e) a detachable top plate for extending over the top of said security housing and for enclosing the top of the opening extending through the outer main structure.

2. The well security housing of claim 1 wherein said pipe aligning insert includes a plurality of opening means that are circumferentially disposed about the aligning insert for enabling filler material such as sand or gravel be directed through the insert into the ground opening such that the filler material may be packed around the well pipe to appropriately support the same within the ground opening.

3. The security well cover of claim 1 wherein said pipe aligning insert includes a centrally disposed well pipe retainer having an opening therein for receiving the well pipe; a plurality of ribs secured to the exterior of said well pipe retainer and extending outwardly therefrom; and a top member spaced upwardly from said well pipe retainer and connected to said ribs.

4. The security well cover of claim 3 wherein openings are formed between the ribs for permitting filler material to be poured downwardly through the well pipe insert.

5. The security well cover of claim 4 wherein said well pipe retainer includes an open cylindrical pipe housing and wherein said top plate includes an annular ring having an inside diameter greater than the outside diameter of the cylindrical pipe housing of the well pipe retainer.

6. The security well cover of claim 5 wherein there is provided means for locking said locking plate means to said well pipe aligning insert.

7. The security well cover of claim 6 wherein said locking means includes an insert opening and a locking tab with a padlock opening extending therethrough, and wherein said locking plate means includes a projecting tab that in a locked position is inserted within the insert opening and wherein the locking plate means further include a slit type opening that in a locked position stradles the locking tab.

8. The security well cover of claim 7 wherein said means for retaining said well pipe insert within the opening of said outer structure includes a flange that projects inwardly from the surrounding wall structure of the outer structure and forms a bottom ledge for receiving the lower portion of the well pipe insert.

9. The security well cover of claim 8 wherein said top plate includes downwardly extending spacer means that engage the combined structure of the locking plate means and well pipe insert so as to support the top plate in a flush position with the surface flange.

10. A multi-piece security well cover and housing for securing a well pipe extending upwardly through a bored ground opening, comprising:

(a) a main outer housing structure having a surrounding wall, top, bottom, and a central opening extending through the same;

(b) means for securing the main outer housing structure in the ground opening such that it surrounds a portion of the well pipe;

(c) well pipe retainer means disposed within said central opening of said housing structure for generally closely surrounding the well pipe and maintaining the well pipe in a generally central position spaced from the surrounding wall structure of said main outer housing;

(d) opening means formed between said well pipe retainer means and the surrounding outer wall structure of the outer housing structure for enabling filler material such as sand and gravel to be poured between the surrounding outer wall structure of the housing structure and the well pipe retainer means; and (e) detachable locking plate means for extending horizontally across the opening of said outer structure at an intermediate height level therein but at a height at least above the position normally occupied by the pipe retainer means for securing and preventing access to the well pipe and the open ground area surrounding the same.

11. The security well cover of claim 10 wherein said locking means includes a generally flat locking plate that is secured directly to the well pipe retainer means.

12. The security well cover and housing of claim 10 wherein there is provided a top plate adapted to be received by said main outer housing structure and wherein there is provided means for securing the top plate within the top portion of the central opening extending through the main housing structure such that a flate upper surface is formed when the security well cover and housing is placed within the ground opening thereby allowing vehicles to conveniently engage and pass thereover.

13. The security well cover and housing of claim 13 wherein the same is provided with flange means secured to the top of the surrounding wall structure of the main housing structure and projecting outwardly therefrom for engaging and resting upon the surroundings surface of the ground opening such that said flange means support the entire security well cover and housing in the ground opening.

14. The security well cover and housing of claim 13 wherein said well pipe includes a well cap and wherein said well pipe retainer means includes means for engaging the cap of the well pipe and supporting the well pipe in the ground opening.

15. A method of securing a well pipe within the ground comprising the steps of: forming a ground opening which includes an upper surrounding surface area; inserting an outer housing structure with a central opening extending therethrough into the formed ground opening; supporting the housing structure within the upper portion of the ground opening by projecting a flange structure from the housing structure outwardly therefrom to where the same engages the upper surrounding surface area extending around the formed ground opening; inserting a well pipe retainer within the central opening of the housing structure and retaining the well pipe retainer within the central opening of the housing structure; inserting a well pipe downwardly through the central opening of the housing structure and through an opening formed within the well pipe retainer and supporting the well pipe by engaging the same; spacing the well pipe within the ground opening and with respect to the housing structure such that the same is generally centrally spaced therein; pouring filler material between the housing structure and the well pipe retainer so as to generally fill the ground opening surrounding the well pipe; securing and preventing access to the well pipe and the open ground area surrounding the same by extending a detachable locking plate across the opening of the outer housing at an intermediate height level therein but at a height at least above the position normally occupied by the well pipe retainer; detachably securing the locking plate to the well pipe retainer; and closing the top of said main housing structure such that the same is closed and lies flush with the ground such that vehicles and the like can engage and travel thereover.

* * * * *